US007079800B2

(12) United States Patent
Asakura et al.

(10) Patent No.: US 7,079,800 B2
(45) Date of Patent: Jul. 18, 2006

(54) IMAGE HEATING DEVICE

(75) Inventors: Kenji Asakura, Kyoto (JP); Keisuke Fujimoto, Hirakata (JP); Masaru Imai, Hirakata (JP); Noboru Katakabe, Uji (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 182 days.

(21) Appl. No.: 10/779,615

(22) Filed: Feb. 18, 2004

(65) Prior Publication Data

US 2004/0161270 A1 Aug. 19, 2004

(30) Foreign Application Priority Data

Feb. 19, 2003 (JP) ..... 2003-040823

(51) Int. Cl.
*G03G 15/20* (2006.01)

(52) U.S. Cl. ..... 399/328; 219/216

(58) Field of Classification Search ..... 399/320, 399/328–331, 335; 219/216, 619
See application file for complete search history.

(56) References Cited

U.S. PATENT DOCUMENTS

2002/0113050 A1* 8/2002 Yura et al. ..... 219/216

FOREIGN PATENT DOCUMENTS

| | | |
|---|---|---|
| JP | 9-160406 | 6/1997 |
| JP | 10232575 | 9/1998 |
| JP | 2002-006658 | 1/2002 |
| JP | 2002082549 A * | 3/2002 |

OTHER PUBLICATIONS

English Language Abstract of JP 10-232575.
English Language Abstract of JP 9-160406.
English Language Abstract of JP 2002-006658.

* cited by examiner

*Primary Examiner*—Arthur T. Grimley
*Assistant Examiner*—Ryan Gleitz
(74) *Attorney, Agent, or Firm*—Greenblum & Bernstein, P.L.C.

(57) ABSTRACT

An image heating device according to an embodiment of the present invention includes a heat generator that has an outer surface and that generates heat by induction heating and a heater positioned close to the outer surface of the heat generator, the heater being configured to heat the heat generator by induction heating. A positioner is located close to an end of the heater, the positioner being configured to position the heater with respect to the heat generator. A vibration absorber is attached to the positioner and is configured, in one embodiment, to viscoelasticly absorb vibration of the heater produced by a vibration caused by an electromagnetic repulsive force acting between the heat generator and the heater when the heater heats the heat generator by induction heating.

18 Claims, 7 Drawing Sheets

IMAGE HEATING DEVICE

BACKGROUND OF THE INVENTION

1. Field of the Invention

The present invention relates to an image heating device, or more specifically, to an image heating device which is preferably applicable to fixing of a non-fixed image used for an electrophotographic device or electrostatic recording device, etc., through heating.

2. Description of the Related Art

As this type of image heating device, there is a conventional proposal on an image heating device using electromagnetic induction. One example of this is an image heating device disclosed in the Unexamined Japanese Patent Publication No.HEI 10-232575.

As shown in FIG. 1, an image heating device 1 is constructed of a fixing member 2 and a pressure roller 3. The fixing member 2 is provided with a stay 4 and a fixing film 5 is attached to this stay 4 in such a way that it is rotatable around the stay 4 in the direction indicated by an arrow. The stay 4 contains an exciting coil 6 and an induction heating plate 7. The exciting coil 6 consists of a core 6*a* made of a ferromagnetic substance and a winding 6*b* which is wound around the core 6*a*. In this way, by passing a high-frequency AC through the winding 6*b* and generating an alternating field, it is possible to generate an eddy current in the induction heating plate 7 and thereby heat the induction heating plate 7. Furthermore, a temperature sensor 8 is provided close to the induction heating plate 7. The high-frequency current is controlled according to the temperature detection result obtained through the temperature sensor 8 and the temperature of the induction heating plate 7 is set to a desired value.

In the image heating device 1, with the induction heating plate 7 being heated, the pressure roller 3 rotates while contacting the induction heating plate 7 under pressure through the fixing film 5 and carries a recording sheet into a nip section of the fixing film 5 which rotates driven by the pressure roller 3. As a result, toner on the recording sheet is heated and pressurized and thereby fixed to the recording sheet.

In addition to such a configuration, the image heating device 1 is provided with a vibration absorption member 9 between the induction heating plate 7 and exciting coil core 6*a*. This prevents image disturbance caused by vibration due to electromagnetic induction.

However, in the above described conventional configuration, the vibration absorption member 9 is placed in an area which is directly heated by electromagnetic induction. For this reason, a highly heat-resistant material needs to be used for the vibration absorption member 9, which increases the cost of the device.

Furthermore, the exciting coil 6 and vibration absorption member 9 are placed inside the fixing film 5 which is heated to a high temperature. For this reason, these components are required to have high heat resistance.

Furthermore, the pressure from the fixing nip is received by the thin induction heating plate 7. This causes a great pressure to act on the vibration absorption member 9 and exciting coil 6. To withstand this great pressure, the vibration absorption member 9 needs to be placed over the entire width, which requires the use of a large amount of the costly vibration absorption member 9.

Moreover, because of the great pressure acting thereupon, it is not easy for the thin vibration absorption member 9 to absorb vibration sufficiently. In the case of insufficient vibration absorption, vibration produced when a high-frequency current passes through the exciting coil 6 is transmitted to the fixing film 5, which disturbs a toner image on the recording sheet in the fixing nip section and may change the rotation speed of the fixing film 5, thus generating jitter on the image in extreme cases.

This tendency may become more noticeable when a high-frequency current not lower than approximately 50 kHz is passed to heat a copper or aluminum material having low magnetic permeability and resistivity.

Furthermore, since it is difficult to fix the exciting coil 6 to the induction heating plate 7 firmly, there is a problem that the positioning reliability deteriorates. As a result, when the distance between the exciting coil 6 and induction heating plate 7 fluctuates, the magnetic coupling condition between the exciting coil 6 and induction heating plate 7 changes, which makes it difficult to perform stable power supply control and prevents accurate temperature control. Consequently, the toner fixing state changes, causing an uneven luster or fixing defect.

SUMMARY OF THE INVENTION

It is an object of the present invention to provide an image heating device having a simple structure capable of reliably positioning a member to be heated and an exciting coil and preventing vibration transmission from the exciting coil to the member to be heated.

A image heating device according to an aspect of the invention comprises a heat generating section that has an outer surface and generates heat by induction heating, a heating section placed close to the outer surface of the heat generating section that heats the heat generating section by induction heating, a positioning section placed close to the end of the heating section that positions the heating section with respect to the heat generating section and a vibration absorption section attached to the positioning section that absorbs vibration of the heating section produced when the heating section heats the heat generating section by induction heating.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DESCRIPTION OF THE PREFERRED EMBODIMENTS

An essence of the present invention is to provide an exciting unit having an exciting coil outside a heat generating member, a positioning section that keeps the distance between this exciting unit and heat generating member to a predetermined distance and a shock-absorbing member at the position of this positioning section.

With reference now to the attached drawings, embodiments of the present invention will be explained in detail below.

(Embodiment 1)

(1) Overall configuration

Figure 1:
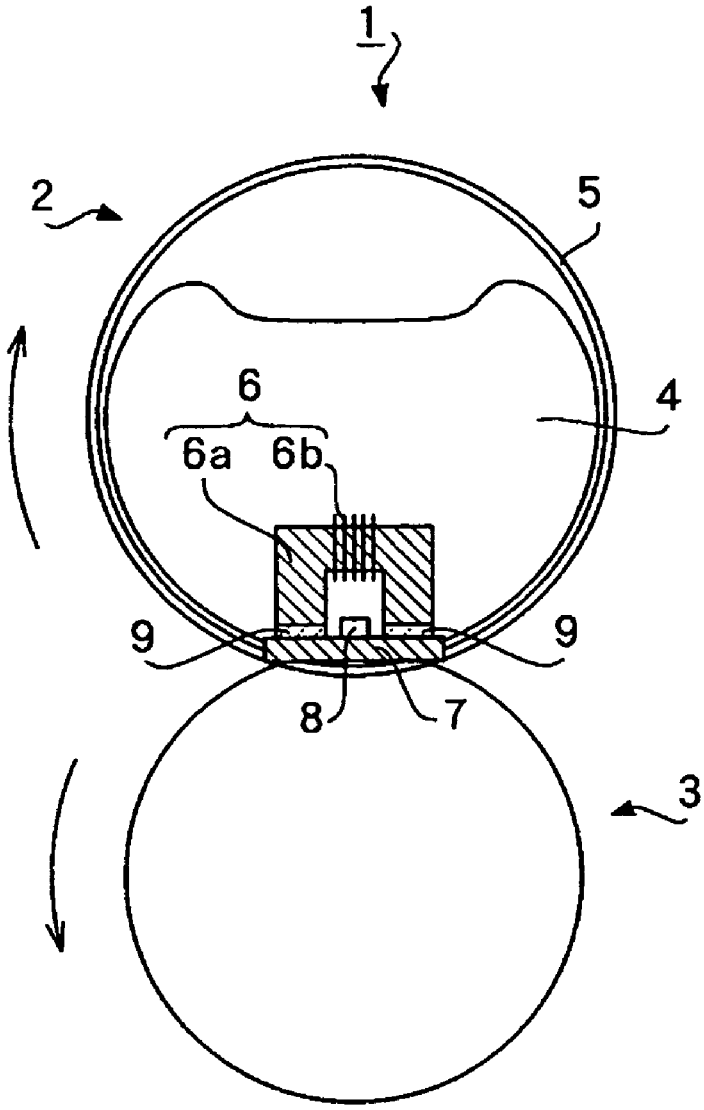
PRIOR ART FIG. 1
FIG. 1 is a partial cross-sectional view showing a configuration of a conventional image heating device.
Figure 2:
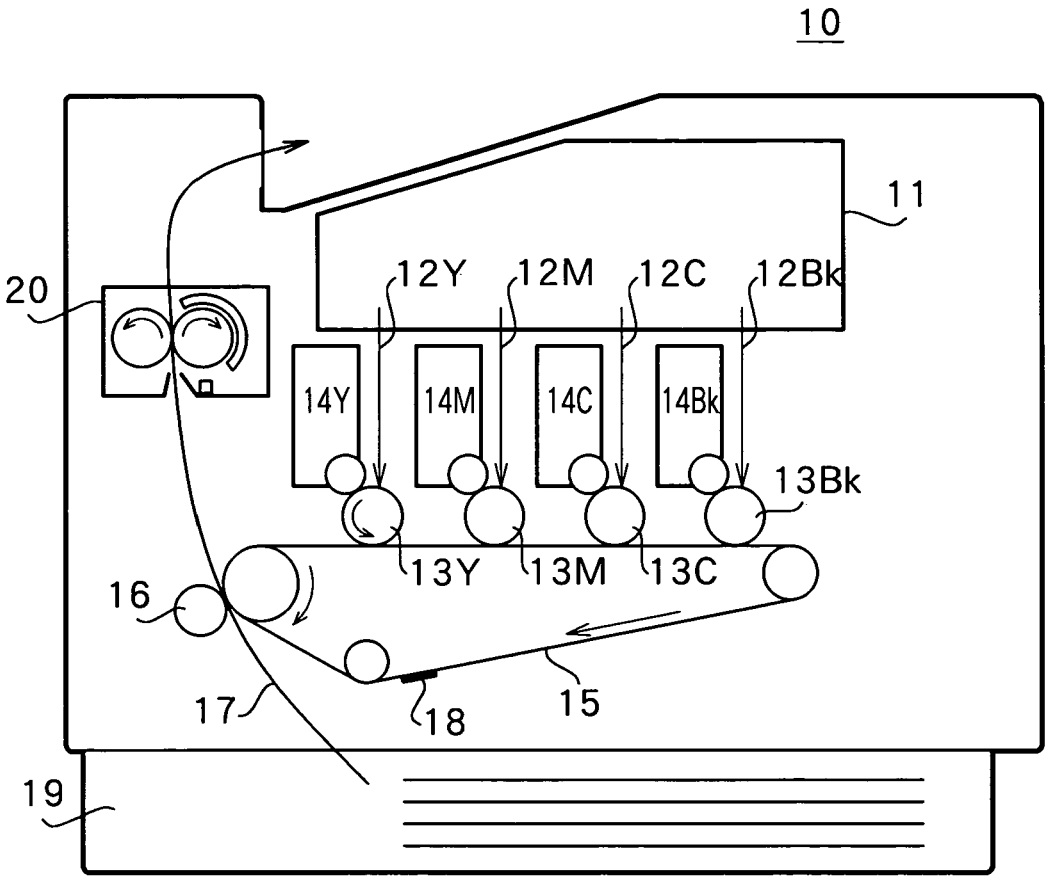
FIG. 2 is a plan view showing an overall configuration of an image formation device to which the image heating device of the present invention is applied.

FIG. 2 shows an overall configuration of an image formation device. An image formation device 10 outputs four laser beams 12Y, 12M, 12C and 12Bk according to an image signal from a photolithography device 11. In this way, latent images of the laser beams 12Y, 12M, 12C and 12Bk are formed on photosensitive members 13Y, 13M, 13C and 13Bk. Developing devices 14Y, 14M, 14C and 14Bk apply toner to the latent images on the photosensitive members 13Y, 13M, 13C and 13Bk to make the images visible. There are four combinations of these photosensitive members and developing devices; Y, M, C and Bk, and the developing devices 14Y, 14M, 14C and 14Bk contain toner of four colors of yellow, magenta, cyan and black respectively. The reference numerals denoting the above described members of the respective colors are accompanied by characters Y, M, C and Bk.

Toner images 18 of four colors formed on the photosensitive members 13Y, 13M, 13C and 13Bk are superimposed one atop another on the surface of an intermediate transfer belt 15 held by support shafts and made to move in the direction indicated by an arrow in the figure. This toner image 18 is transferred to a recording sheet 17 at the position of a secondary transfer roller 16.

The secondary transfer roller 16 is provided so as to be contiguous to the intermediate transfer belt 15. Furthermore, by applying an electric field to the secondary transfer roller 16 pressed against the intermediate transfer belt 15 with the recording sheet 17 sandwiched in between, the secondary transfer roller 16 transfers the toner image 18 superimposed on the intermediate transfer belt 15 to the recording sheet 17. A paper feed unit 19 feeds the recording sheet 17 at appropriate timings.

The recording sheet 17 to which the toner image 18 has been transferred is sent to an image heating device 20. The image heating device 20 heats and pressurizes the recording sheet 17 with the transferred toner image 18 preferably at a fixing temperature of approximately 170° C. to thereby fix the toner image 18 to the recording sheet 17.

(2) Configuration of Image Heating Device

Figure 3:
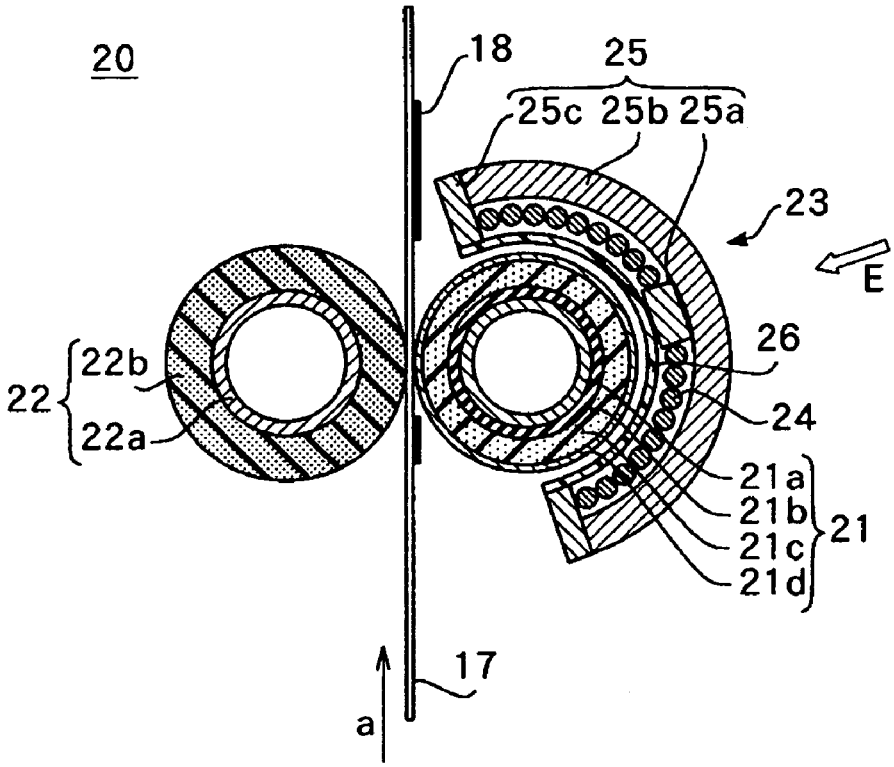
FIG. 3 is a partial cross-sectional view showing a configuration of an image heating device according to Embodiment 1.

FIG. 3 shows a configuration of the image heating device 20 according to this embodiment. The image heating device 20 is constructed of a heat generating roller 21 supported by a rotation axis (not shown) in a rotatable manner, a pressure roller 22 that presses the recording sheet 17 sandwiched between the pressure roller 22 and the heat generating roller 21 and an exciting unit 23 provided along the outer surface of the heat generating roller 21 and containing an exciting coil 24 for induction-heating the heat generating roller 21.

Thus, the image heating device 20 according to this embodiment provides the exciting unit 23 outside the heat generating roller 21 so that the external exciting unit 23 induction-heats the heat generating roller 21.

Then, more specific configurations of the heat generating roller 21, pressure roller 22 and exciting unit 23 will be explained. The heat generating roller 21 has a laminated structure formed of a hollow cored bar 21*a* made of aluminum or the like, a magnetic layer 21*b* made of an insulating material and a sponge layer 21*c* having high thermal insulating property and elasticity.

Furthermore, a heat generating belt 21*d* is provided on the surface of the heat generating roller 21. The heat generating belt 21*d* consists of an aluminum base material as a dielectric heat generating layer with an elastic layer and mold releasing layer formed thereupon in that order. It is also possible to use any one of metal materials such as copper, silver, nickel, stainless steel and iron instead of using aluminum as the base material of the heat generating belt 21*d*. Or it is also possible to use a composite material made up of a plurality of these metal materials. Or it is also possible to use a composite material made up of at least one of these metal materials and resin such as polyimide.

The heat generating belt 21*d* may also be adhered to the sponge layer 21*c* as one body or may be simply attached onto the outer surface of the sponge layer 21*c*. Moreover, an induction heating layer may also be formed directly on the sponge layer 21*c*.

The pressure roller 22 is constructed of a cored bar 22*a* and a silicon rubber layer 22*b* and pressed against the heat generating belt 21*d* to form a fixing nip section. The pressure roller 22 is rotated and driven by a driving section (not shown) of the device body. In this way, the heat generating roller 21 rotates driven by the rotation of the pressure roller 22 and the recording sheet 17 sandwiched between the heat generating roller 21 and pressure roller 22 is moved in the direction indicated by an arrow a in the figure. At this time, the toner image 18 on the recording sheet 17 is heated by the heat generating belt 21*d*, pressurized by the heat generating roller 21 and pressure roller 22 and thereby fixed.

The exciting unit 23 has an arc-shaped cross section as a whole. Aback core 25 is provided on its outer surface and a coil holding member 26 is provided on its inner surface and an exciting coil 24 is provided between the back core 25 and coil holding member 26.

The exciting coil 24 is formed of a predetermined number of surface-insulated conductive wire members bundled together and extended around the heat generating roller 21 in the axial direction. In other words, the exciting coil 24 is provided in the circumferential direction of the heat generating belt 21*d* so as to cover and surround the heat generating belt 21*d* in close contact with each other. The ends of the exciting coil 24 are heaped with the overlapped wire bundle and look saddle-shaped as a whole. The exciting coil 24 is preferably placed at a distance of approximately 3 mm from the outer surface of the heat generating belt 21*d*.

Figure 5:
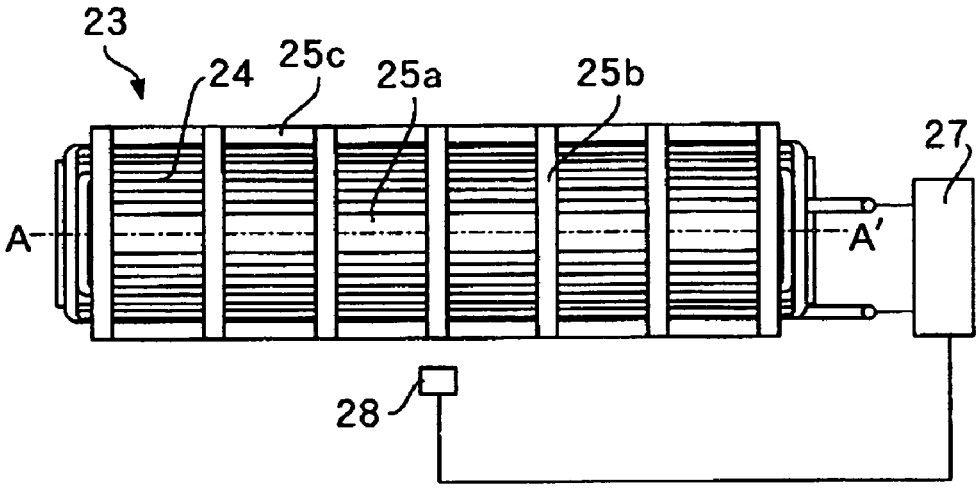
FIG. 5 is a perspective view of principal components of the image heating device viewed from the direction indicated by the arrow E in FIG. 3.

The back core 25 is principally made of ferrite and consists of a central core 25*a* placed on the inner surface around the coil, an arch-shaped arch core 25*b* and an end core 25*c* placed on the outer surface of the exciting coil 24. As shown in FIG. 5 which is viewed from the direction indicated by an arrow E in FIG. 3, a predetermined number (e.g., 7) of arch cores 25*b* are arrayed on the back of the exciting coil 24 with a certain space in between. The central core 25*a*, end core 25*c* and arch core 25*b* which are continuous in the axial direction each consist of a combination of a plurality of members. As the material of the back core 25, a material with high magnetic permeability and high resistivity such as permalloy is preferable in addition to ferrite.

The coil holding member 26 is made of resin with high heatproof temperature such as PEEK (polyether ether ketone) material or PPS (polyphenylene sulfide) preferably of approximately 1.5 mm in thickness and holds the exciting coil 24.

Here, the induction heating operation of the heat generating belt 21*d* by the exciting unit 23 will be explained using FIG. 4 and FIG. 5.

An AC current having a predetermined frequency is applied from an exciting circuit 27 (FIG. 5) to the exciting coil 24. This frequency is selected preferably from a frequency range of approximately 20 to 100 kHz according to the material of the base material of the heat generating belt 21*d*. For example, in the case where the heat generating belt 21*d* is an aluminum base material, a frequency of approximately 60 kHz is selected.

The AC current applied to the exciting coil 24 is controlled by a temperature signal obtained from a temperature sensor 28 (FIG. 5) so that the surface of the heat generating belt 21*d* is set to approximately 170° C. which is a predetermined fixing set temperature.

Figure 4:
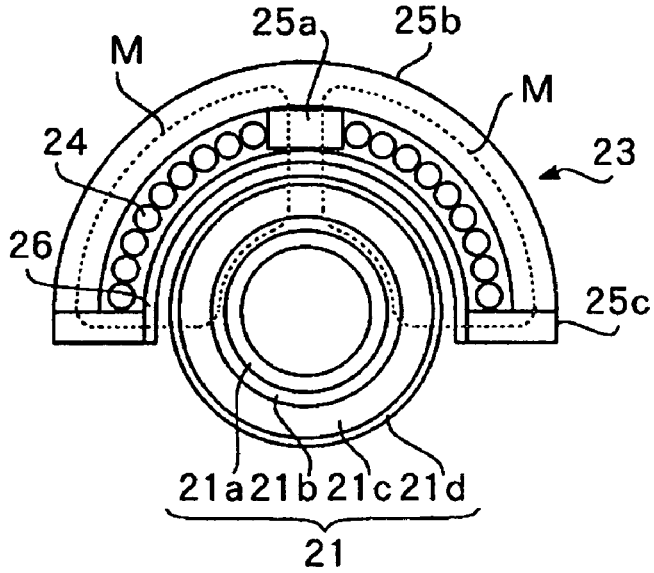
FIG. 4 illustrates the operation of induction heating by the image heating device.

Here, magnetic flux generated by the exciting coil 24 through the AC current from the exciting circuit 27 penetrates the heat generating belt 21*d* from the end core 25*c* and reaches the magnetic layer 21*b* as shown by a dashed line M in FIG. 4. Due to the magnetism of the magnetic layer 21*b*, the magnetic flux M penetrates the magnetic layer 21*b* in the circumferential direction. Then, the magnetic flux M forms an alternating field forming a loop which penetrates the heat generating belt 21*d* again and passes through the central core 25*a*. The induced current generated by the change of this magnetic flux passes through the base material layer of the heat generating belt 21*d* and generates joule heat. Since the magnetic layer 21*b* has insulating properties, it is not induction-heated.

Furthermore, since the magnetic flux M does not reach the cored bar 21*a* of the heat generating roller 21, induction heating energy is never used directly for heating of the cored bar 21*a*. Furthermore, since the heat generating belt 21*d* is held with the highly thermal insulating sponge layer 21*c*, less heat leaks from the heat generating belt 21*d*. For this reason, the thermal capacity of the heated part is small and has low thermal conductivity, and it is therefore possible to heat the heat generating belt 21*d* up to a desired temperature (e.g., fixing set temperature) in a short time.

Figure 6:
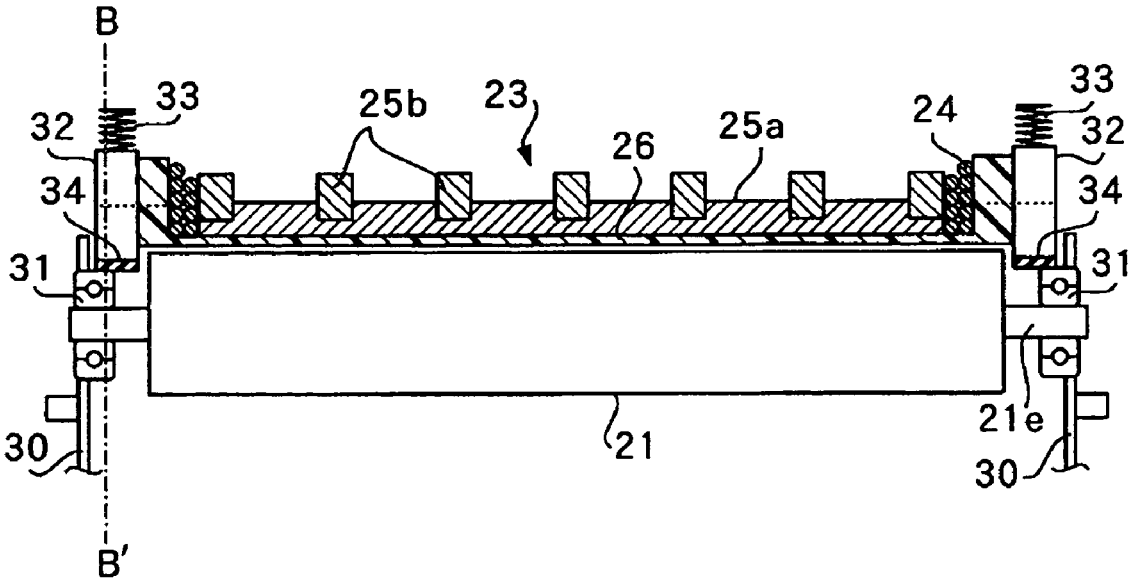
FIG. 6 illustrates a mounting structure of the exciting unit and heat generating roller.

Then, the mounting structure of the exciting unit 23 and heat generating roller 21 of this embodiment will be explained using FIG. 6. FIG. 6 shows the cross section along a line A–A' in FIG. 5 of the exciting unit 23 as well as the mounting part of the exciting unit 23 and heat generating roller 21.

The heat generating roller 21 has a structure in which its rotation axis 21*e* is supported by a bearing 31 which is fixed to a unit chassis 30 of the image heating device 20 in a rotatable manner. The unit chassis 30 also holds the pressure roller 22 as one unit and forms a fixing unit detachable to the body of the device. A positioning section 32 is provided at the end of the exciting unit 23. The positioning section 32 and bearing 31 determine the position of the exciting unit 23 relative to the position of the heat generating roller 21.

In addition to such a configuration, a shock-absorbing member 34 is provided between the bearing 31 and positioning section 32. As this shock-absorbing member 34, for example, fluorine-based or silicon-based heat resistant rubber is used. The material of the shock-absorbing member 34 will be described in detail later.

The exciting unit 23 is placed under pressure of a pressure spring 33 attached to the positioning section 32 in such a way as to approach the heat generating roller 21. In this way, the distance between the heat generating roller 21 and exciting unit 23 is determined by the positions of the bearing 31 and positioning section 32 which are pressed against each other through the shock-absorbing member 34 with the exciting unit 23 being pressed by the pressure spring 33. The heat generating roller 21 and exciting unit 23 are actually positioned in such a way that the distance between the surface of the heat generating roller 21 (that is, heat generating belt 21*d*) and the exciting coil 24 in the exciting unit 23 is preferably approximately 3 mm.

Figure 7:
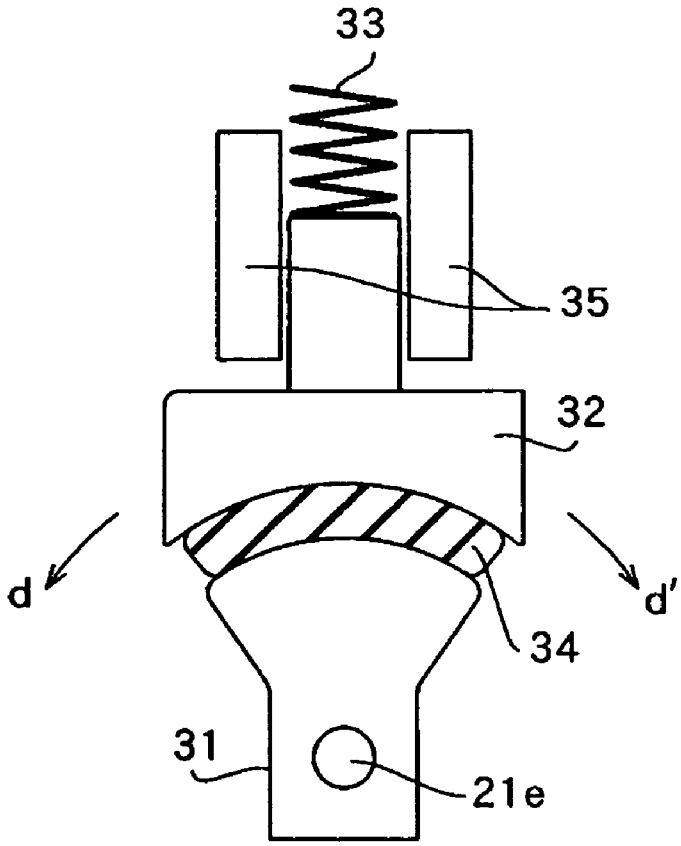
FIG. 7 is a partial cross-sectional view along a line B–B' showing details of the mounting structure of the exciting unit and heat generating roller.

This positioning structure will be explained in further detail using FIG. 7. FIG. 7 shows a cross section along a line B–B' in FIG. 6. The positioning section 32 is regulated by a slide guide 35 provided in the body of the image heating device 20 and movable only in the direction in which it approaches the heat generating roller 21, in other words, only in the direction of the radius of the heat generating roller 21.

Furthermore, the surface of the bearing 31 (that is, the surface facing the positioning section 32 with the shock-absorbing member 34 in between) and the surface of the positioning section 32 facing the bearing 31 with the shock-absorbing member 34 in between form a circumferential surface along the circumferential surface of the heat generating roller 21 (that is, heat generating belt 21*d*), that is, the circumferential surface parallel to the circumferential surface of the heat generating roller 21 (or heat generating belt 21*d*). Then, the shock-absorbing member 34 is provided between the circumferential surfaces of the bearing 31 and positioning section 32. In this way, even if the positioning section 32 is shifted slightly in the direction indicated by an arrow d or arrow d', it is possible to prevent the exciting unit 23 from contacting the heat generating belt 21*d* and keep the distance between the exciting unit 23 and the heat generating belt 21*d* to a predetermined distance.

Here, suppose a case where the surface of the bearing 31 and the surface of the positioning section 32 are formed of flat surfaces. In this case, if a positional shift is produced in the direction orthogonal to the rotation axis of the heat generating roller 21, the end of the exciting unit 23 may possibly contact the surface of the heat generating belt 21*d*, damaging the heat generating belt 21*d*. This is because the heat generating belt 21*d* and the surface of the exciting unit 23 facing the heat generating belt 21*d* have mutually circumferential shapes. Therefore, this embodiment forms the surface of the bearing 31 and the surface of the positioning section 32 facing the bearing 31 with the shock-absorbing member 34 in between in a shape conforming to the circumferential surface of the heat generating roller 21. This can reliably avoid the above described trouble.

Both the shock-absorbing member 34 and sponge layer 21*c* have elasticity and the relationship between coefficients of these elastic moduli is preferably shock-absorbing member>sponge layer. With regard to hardness, a material with a hardness level of approximately 20 degrees to 80 degrees according to the JIS (Japanese Industrial Standards)-

A can be used for the shock-absorbing member 34 and approximately 30 degrees to 70 degrees is preferably used. When the shock-absorbing member 34 is too soft (e.g., when hardness is smaller than approximately 20 degrees), the gap between the exciting coil 24 and the heat generating layer of the heat generating belt 21*d* is liable to fluctuate, and on the contrary when the shock-absorbing member 34 is too hard (e.g., when hardness is greater than approximately 80 degrees), the buffering action decreases.

On the other hand, a material with a degree of hardness of approximately 20 degrees to 50 degrees according to Asker-C (hardness specified by the standard of the Society of Rubber Industry, Japan) can be used for the sponge layer 21*c* and approximately 30 degrees to 50 degrees is preferable. If the sponge layer 21*c* is too soft (e.g., when hardness is lower than approximately 20 degrees), it is not possible to apply a sufficient pressure at the fixing nip section and when the sponge layer 21*c* is too hard (e.g., when hardness is greater than approximately 50 degrees), it is not possible to secure the sufficient nip width.

(3) Operation of Embodiment

In the above described configuration of the image heating device 20, the positioning section 32 and the bearing 31 are pressed against each other through the shock-absorbing member 34 in between, and in this way the distance between the heat generating belt 21*d* to be heated and the exciting unit 23 is determined. Since the bearing 31 of the heat generating roller 21 is used for positioning, the relative positions of the heat generating roller 21 and exciting unit 23 remain unchanged, the distance between the heat generating roller 21 and exciting unit 23 can be kept to a predetermined distance.

This makes it possible to keep the distance between the exciting coil 24 in the exciting unit 23 and the heat generating belt 21*d* constant, allow magnetic flux generated at the exciting coil 24 to enter the heat generating belt 21*d* efficiently and accurately and heat the heat generating belt 21*d* efficiently and accurately.

In this condition, if a high-frequency current is passed from the exciting circuit 27 into the exciting coil 24 as an exciting current, the heat generating belt 21*d* is induction-heated by an alternating field. At this time, an induced current flows through the heat generating belt 21*d* in the direction opposite the direction of the exciting current which is always passing through the exciting coil 24 due to a mutual induction action. Then, because of Fleming's left-hand rule, repulsive forces which act in mutually repelling directions are generated between the exciting coil 24 and heat generating belt 21*d*. The magnitude of the repulsive forces is proportional to the square of the exciting current. Furthermore, the vibration force caused by this electromagnetic repulsive force has a frequency approximately twice the frequency of the exciting current (exciting frequency).

Furthermore, when the DC power supply output voltage of the power supply of the exciting current is a pulsating current including a ripple component, the exciting current is subjected to amplification modulation by the ripple component, and therefore a component having substantially the same frequency as the ripple frequency is also generated in the vibration force. The ripple frequency varies depending on the circuit configuration of the DC power supply. In the case of a DC power supply using a full-wave rectifying circuit, the ripple frequency is double the AC input frequency and in the case of a DC power supply using a half-wave rectifying circuit, the ripple frequency is the same as the AC input frequency.

For example, suppose the exciting circuit 27 generates a high-frequency current of 20 kHz using a DC power supply resulting from full-wave rectification of 60 Hz AC input, supplies the high-frequency current to the exciting coil 24 and thereby drives the exciting coil 24. In this case, a vibration force of 120 Hz (same frequency as the ripple frequency caused by the ripple component of the high-frequency current) and a vibration force of 40 kHz (frequency double the exciting frequency caused by electromagnetic repulsive force) are generated between the exciting coil 24 and heat generating belt 21*d*.

However, since the vibration caused by this vibration force is absorbed by the shock-absorbing member 34, the vibration amplitude of the heat generating roller 21 is prevented from expanding. When the loss factorloss factor (a kind of index indicating vibration absorption performance) of the shock-absorbing member 34 at the vibration frequency falls below approximately 0.01, almost no vibration is absorbed by the shock-absorbing member 34. Therefore, in order for optimal vibration absorption by the shock-absorbing member 34 to take place, the loss factorloss factor should be approximately 0.01 or above or preferably approximately 0.1 or above. A loss factorloss factor for each specific preferred material is approximately 0.05 to approximately 0.15 for natural rubber, approximately 0.15 to approximately 0.3 for chloroprene, approximately 0.25 to approximately 0.4 for nitrile rubber, approximately 0.15 to approximately 0.3 for styrene-butadiene rubber and approximately 0.25 to approximately 0.4 for butyl rubber, etc. In addition, various resin materials or viscoelastic materials having a loss factor of approximately 0.01 or above can be used as materials for the shock-absorbing member 34.

However, when the material is actually selected, it is necessary to consider influences of the operating temperature. In the case of the shock-absorbing member 34 used for the image heating device 20, a temperature rise during operation is unavoidable due to heat transmission from the heat generating belt 21*d*. Therefore, a resin material or viscoelastic material displaying vibration absorption performance of a certain level or higher (having a loss factor of approximately 0.01 or above in this embodiment) at an arbitrary operating temperature is selected.

Figure 8:
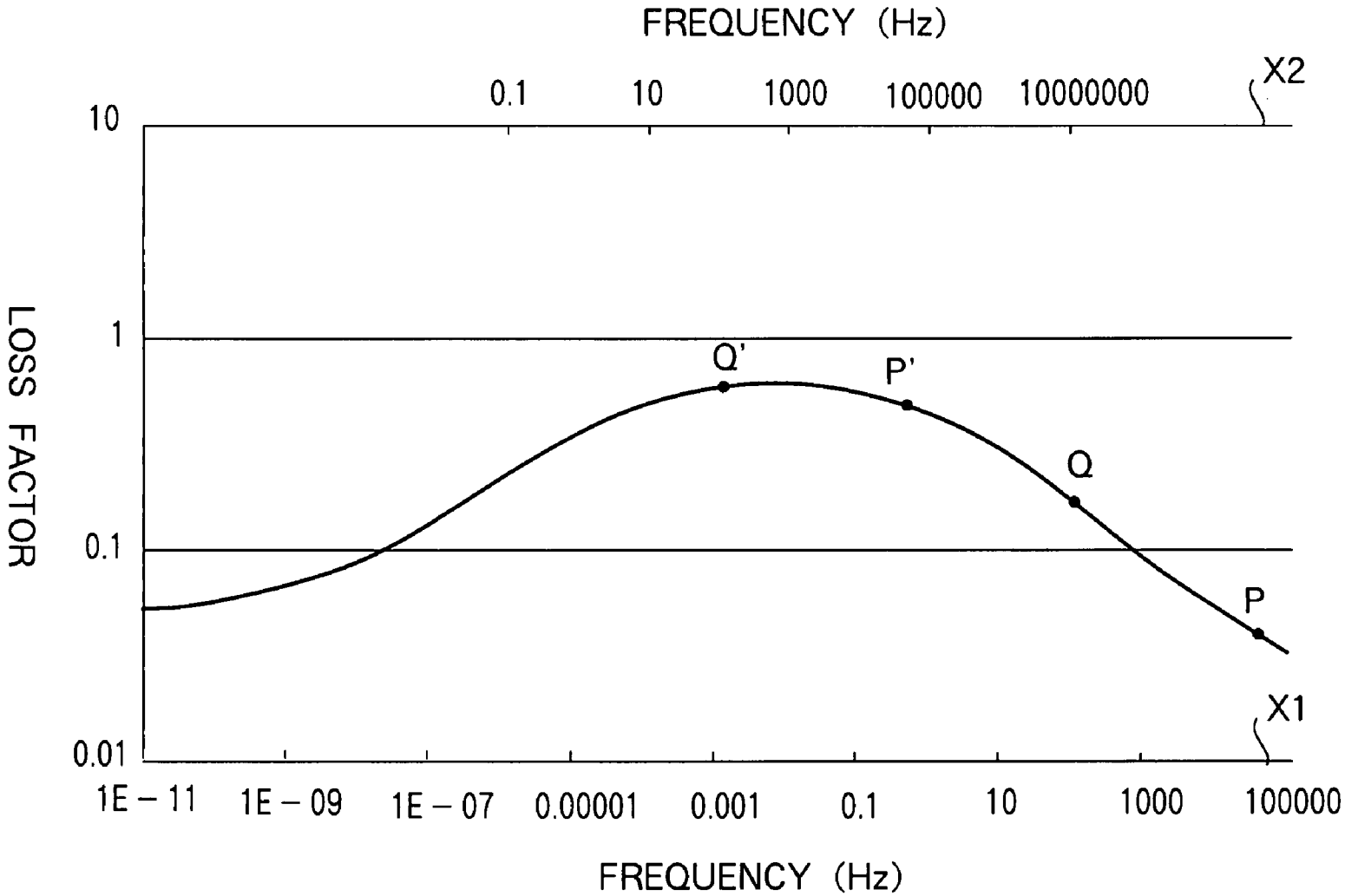
FIG. 8 illustrates a characteristic of loss factor regarding one example of a vibration absorption material used as a shock-absorbing member.

A high polymer material such as rubber and resin, etc., generally shows similar frequency characteristics of viscoelasticity when the temperature rises and when the vibration frequency decreases. Here, FIG. 8 shows a frequency characteristic of a loss factor of a vibration absorption material principally composed of styrene-butadiene rubber. The data shown in FIG. 8 is obtained by converting a test result on a loss factor of styrene-butadiene rubber described in "Elastomers for damping over wide temperature ranges" (Owens, F. S., AFML-TR-68-179, Wright-Patterson AFB, Ohio, 1968) to a case of approximately 20° C. and a case of approximately 50° C. The horizontal axis X1 in FIG. 8 corresponds to the vibration frequency in the case of approximately 20° C. The frequency characteristic graph (curve) shifts rightward as the temperature rises. This is equivalent to the frequency axis shifting leftward as the temperature rises. Therefore, in FIG. 8, the horizontal axis X2 corresponds to the vibration frequency in the case of approximately 50° C.

In FIG. 8, point P indicates the loss factor in the case of approximately 20° C. corresponding to the vibration force having a frequency (e.g., 40 kHz) approximately double the exciting frequency. Point Q indicates the loss factor in the case of approximately 20° C. corresponding to the vibration force having the loss factor substantially the same as the ripple frequency (e.g., 120 Hz). Both the loss factor at point P and the loss factor at point Q exceed 0.01 and the loss factor at point Q even exceeds 0.1. Therefore, the vibration absorption material principally composed of styrene-butadiene rubber (or other material having a similar nature) at least at a normal temperature (e.g., approximately 20° C.) can carry out the vibration absorption function of the shock-absorbing member 34 sufficiently. It effectively functions for vibration caused by the ripple component of a high-frequency current in particular.

Here, suppose the temperature of the shock-absorbing member 34 has risen to approximately 50° C. which is a somewhat higher temperature than a normal temperature due to heat transmission from the heat generating belt 21*d*. Point P' and point Q' indicate loss factors for this case. Point P' indicates a loss factor in the case of 50° C. corresponding to a vibration force having a frequency approximately twice the exciting frequency (e.g., 40 kHz) and point P' indicates a loss factor in the case of approximately 50° C. corresponding to a vibration force having a frequency (e.g., 120 Hz) substantially the same as the ripple frequency. Both exceed the loss factor in the case of approximately 20° C. (that is, loss factor at point P and loss factor at point Q).

That is, in the case of a vibration absorption material principally composed of styrene-butadiene rubber (or other material having a similar nature), even if the temperature increases at least near a normal temperature, the vibration absorption performance can be expected to improve. This can be realized when a vibration absorption material characterized in that the frequency giving a maximum loss factor at a normal temperature is smaller than the frequency of the vibration force is adopted.

Furthermore, in the case of a vibration absorption material principally composed of styrene-butadiene rubber (or other material having a similar nature), even if the temperature further rises and the frequency axis is further shifted leftward, the loss factor never falls below 0.01. For this reason, the vibration absorption material principally composed of styrene-butadiene rubber (or other material having a similar nature) has excellent vibration absorption performance for a further temperature rise. Thus, when a material having a loss factor of approximately 0.01 or above in a frequency area lower than the frequency of the vibration force in question at a normal temperature is used, it is possible to maintain an excellent vibration absorption effect even if a drastic temperature rise occurs.

As a result, the image heating device 20 is free of such problems that the heat generating belt 21*d* vibrates and disturbs a non-fixed toner image 18 or changes the rotation speed causing jitter, and is therefore easy to handle and can provide a high definition image.

Furthermore, the shock-absorbing member 34 can be placed in a location apart from the heat generating area, and therefore it is possible to provide the shock-absorbing member 34 with relatively low heat resistance (that is, low heat resistance compared to the vibration absorption member placed in the area which is directly heated by electromagnetic induction) and therefore use a relatively inexpensive material for the shock-absorbing member 34.

When aged deterioration, etc., occurs in the heat generating belt 21*d*, the image heating device 20 of this embodiment is designed to be able to leave the exciting unit 23 in the main body and remove and replace the heat generating roller 21 and pressure roller 22 together with the bearing 31 and unit chassis 30 as a fixing unit. When these components are replaced, the elastic force of the pressure spring 33 of the exciting unit 23 is held by a stopper (not shown). In this condition, the fixing unit including the heat generating roller 21 is removed and a new fixing unit is attached instead of this. When the new fixing unit is attached, it is set in a predetermined position while pressing the shock-absorbing member 34 by means of the bearing 31. In this condition, positioning is performed with the shock-absorbing member 34 contacting the bearing 31 by the pressure spring 33.

In this way, with the image heating device 20, it is possible to leave the exciting unit 23 in the main body and easily replace the fixing unit including the heat generating roller 21. Even after the replacement, the respective components can be positioned at exact positions through the positioning section 32, bearing 31 and pressure spring 33.

(4) Effects of Embodiment

According to the above described configuration, by providing the exciting unit 23 outside the heat generating roller 21 provided with the heat generating belt 21*d* to be heated, forming the positioning section 32 at the end of this exciting unit 23, further providing the shock-absorbing member 34 between the positioning section 32 and contact member (bearing 31 in this embodiment) to thereby keep the distance between the exciting unit 23 and heat generating roller 21 to a predetermined distance, it is possible to realize the image heating device 20 in a simple configuration capable of reliably keeping the distance between the exciting coil 24 provided inside the exciting unit 23 and the heat generating belt 21*d* provided in the heat generating roller 21 to a predetermined value and reliably preventing vibration transmission from the exciting unit 23 to the heat generating roller 21.

(Embodiment 2)

Figure 9:
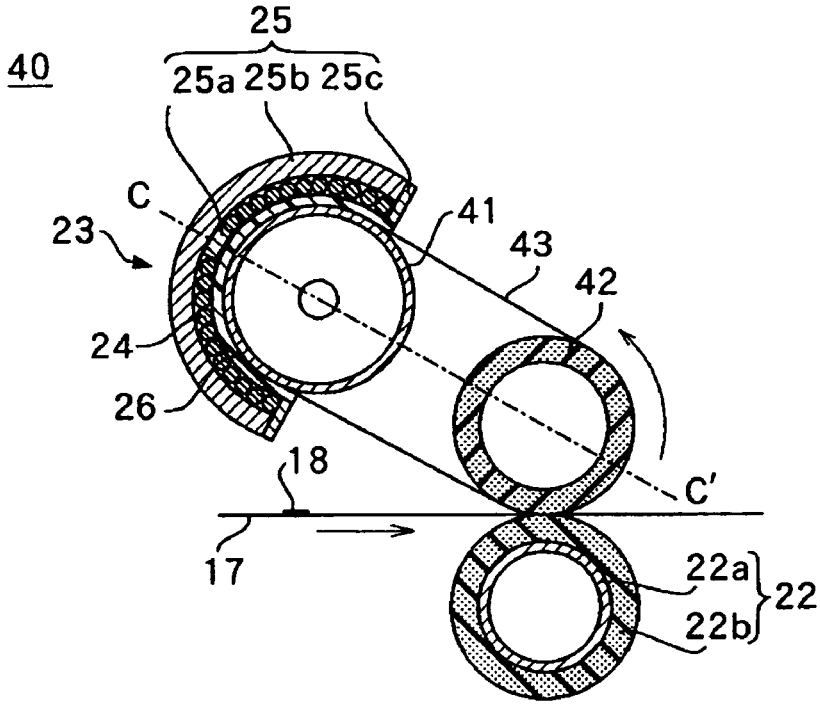
FIG. 9 is a partial cross-sectional view showing a configuration of an image heating device according to Embodiment 2.

FIG. 9 shows a configuration an image heating device according to Embodiment 2 of the present invention. A image heating device 40 shown in FIG. 9 has a basic configuration similar to that of the image heating device 20 in FIG. 3 explained in Embodiment 1 and the same or corresponding components are assigned the same reference numerals and detailed explanations thereof will be omitted.

In the image heating device 40, a heat generating belt 43 is not formed so as to be wound around the surface of an auxiliary roller 41, but formed so as to be run between an auxiliary roller 41 and a fixing roller 42. That is, the heat generating belt 43 is induction-heated at the position of the auxiliary roller 41 by an exciting unit 23 and the heated heat generating belt 43 is designed to heat a toner image 18 on a recording sheet 17 at the position of the fixing roller 42.

For the auxiliary roller 41, it is possible to use induction-heated magnetic metal such as iron and SUS, insulating material such as heat-resistant resin or highly resistant or insulating magnetic material such as ferrite. The fixing roller 42 has a structure with sponge made of foamed silicon rubber laminated on a cored bar.

Figure 10:
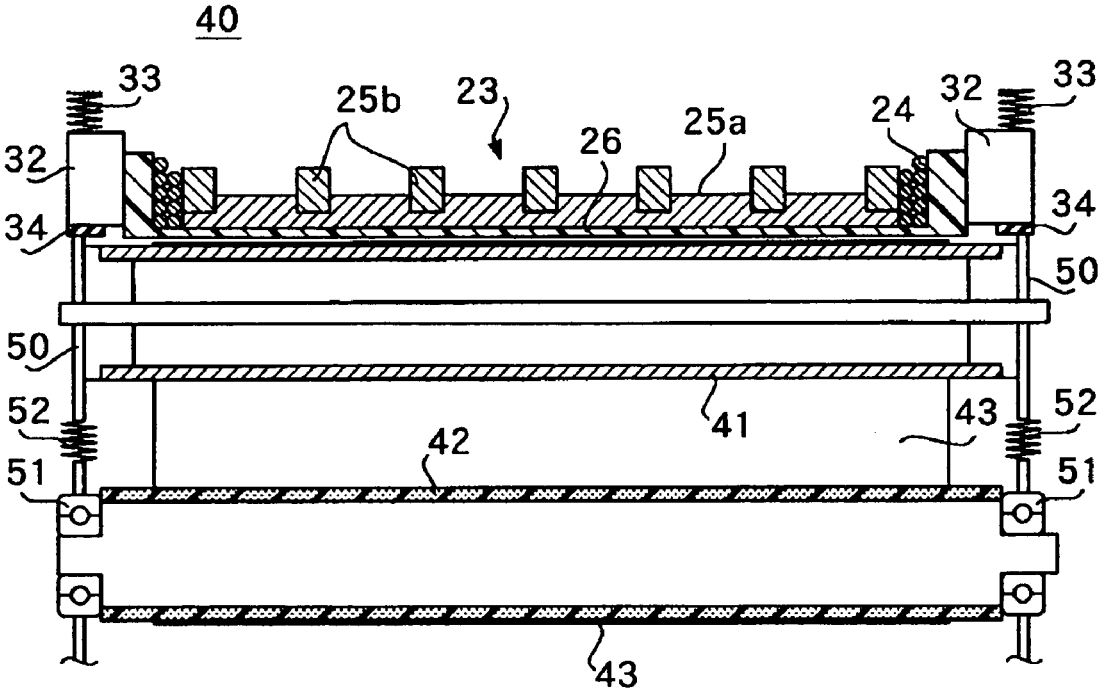
FIG. 10 illustrates a mounting structure of an exciting unit, auxiliary roller and fixing roller according to Embodiment 2.

FIG. 10 shows a mounting structure of the exciting unit 23, auxiliary roller 41 and fixing roller 42 of this embodiment. FIG. 10 shows the mounting part of the exciting unit 23, auxiliary roller 41 and fixing roller 42 in addition to the cross section along a line C–C' in FIG. 9 of the exciting unit 23, auxiliary roller 41 and fixing roller 42.

The auxiliary roller 41 is mounted on a bearing 50 in a rotatable manner and the fixing roller 42 is mounted on a bearing 51 in a rotatable manner. Furthermore, the bearing 50 and bearing 51 are biased by a spring 52 in the direction in which both bearings go away from each other. Through the spring force of the spring 52, the heat generating belt 43 is run between the auxiliary roller 41 and fixing roller 42 without flexure.

In addition to such a configuration, as in the case of Embodiment 1, the auxiliary roller 41 and exciting unit 23 are placed in such a way that the bearing 50 of the auxiliary roller 41 and a positioning section 32 are pressed against each other through a shock-absorbing member 34. This makes it possible to hold the distance between the auxiliary roller 41 and exciting unit 23 to a predetermined distance and prevent transmission of micro vibration from the exciting unit 23 to the fixing roller 42.

That is, in the image heating device 40 according to this embodiment, the auxiliary roller 41 and fixing roller 42 are connected through the heat generating belt 43 and the respective bearings 50 and 51, and transmission of micro vibration from the exciting unit 23 to the fixing roller 42 is prevented by the shock-absorbing member 34. In this way, when the auxiliary roller 41 receives vibration from the exciting unit 23, it is possible to reduce the possibility that the fixing roller 42 may vibrate and disturb a non-fixed toner image or the possibility that the rotation speed may fluctuate and produce jitter.

When the heat generating belt 43 to be heated is run between the auxiliary roller 41 and the fixing roller 42, and this heat generating belt 43 is induction-heated with the exciting unit 23 provided outside the auxiliary roller 41, the above described configuration forms the positioning section 32 at the end of this exciting unit 23, provides the shock-absorbing member 34 between the positioning section 32 and contact member (bearing 50 in this embodiment) and keeps the distance between the exciting unit 23 and auxiliary roller 41 to a predetermined distance, and can thereby realize the image heating device 40 in a simple configuration capable of reliably keeping the distance between the exciting coil 24 and heat generating belt 43 provided inside the exciting unit 23 to a predetermined value and reliably prevent vibration transmission from the exciting unit 23 to the fixing roller 43.

(Other Embodiments)

Embodiments 1 and 2 have described the case where the bearings 31 and 50 of the heat generating roller 21 and the auxiliary roller 41 are used as the contact members which the positioning section 32 contacts through the shock-absorbing member 34. However, the contact members which contact the positioning section 32 are not limited to the bearings of the heat generating roller 21 and the auxiliary roller 41. In brief, any member is acceptable if it can at least keep the distance between the heat generating roller 21 or auxiliary roller 41 and the exciting unit 23 to a predetermined value when the positioning section 32 contacts it through the shock-absorbing member 34.

Furthermore, Embodiments 1 and 2 have shown the case where the shock-absorbing member 34 is provided between the positioning section 32 and the bearings 31 and 50. However, the present invention is not limited to this. For example, it is also possible to provide the shock-absorbing member 34 in the joint between the exciting unit 23 and positioning section 32. In this case, too, it is possible to prevent vibration transmission from the exciting unit 23 to the heat generating belts 21*d* and 43 or fixing roller 42. Furthermore, in this case, there is no need to place the shock-absorbing member 34 between the positioning section 32 and contacting member (bearings 31 and 50 in Embodiments 1 and 2) Therefore, it is possible to keep the distance between the exciting unit 23 and heat generating roller 21 or auxiliary roller 41 more accurately and stably.

As described above, according to the present invention, by providing the exciting unit having the exciting coil outside the heat generating member, providing the positioning section which keeps the distance between this exciting unit and heat generating member and providing the shock-absorbing member at the position of this positioning section, it is possible to realize an image heating device in a simple configuration capable of accurately and reliably positioning the distance between the heat generating member and exciting coil and reliably preventing vibration transmission from the exciting coil to the heat generating member.

The present invention is not limited to the above described embodiments, and various variations and modifications may be possible without departing from the scope of the present invention.

This application is based on the Japanese Patent Application No.2003-040823 filed on Feb. 19, 2003, the entire content of which is expressly incorporated by reference herein.

What is claimed is:

1. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator; and a vibration absorber attached to said positioner and that is configured to viscoelasticly absorb vibration of said heater produced by a vibration resulting from an electromagnetic repulsive force acting between said heat generator and said heater when said heater heats said heat generator by induction heating.

2. The image heating device according to claim 1, wherein said heat generator extends between a plurality of rollers each having a rotation axis, and the image heating device further comprises a support that rotatably supports the rotation axis of a roller, of said plurality of rollers, that is positioned adjacent the heater and said vibration absorber is positioned between said positioner and said support.

3. The image heating device according to claim 1, wherein said vibration absorber comprises a material with a vibration absorption performance that exceeds a predetermined level at an arbitrary operating temperature.

4. The image heating device according to claim 1, wherein said heat generator is provided on a roller having a rotation axis, and the image heating device further comprises a support that rotatably supports the rotation axis of said roller, and said vibration absorber being positioned between said positioner and said support.

5. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator; and a vibration absorber attached to said positioner that is configured to absorb vibration of said heater produced when said heater heats said heat generator by induction heating, wherein:

said vibration absorber is positioned between said heater and said positioner.

6. An image heating device comprising:

a heat generator that is provided on a roller having a rotation axis, that has an outer surface, and that generates heat by induction heating;

a heater positioned close to the outer surface of said heat generator, said heater being configured to heat said heat generator by induction heating;

a positioner located close to an end of said heater, said positioner being configured to position said heater with respect to said heat generator;

a vibration absorber attached to said positioner, said vibration absorber being configured to absorb vibration of said heater produced when said heater heats said heat generator by induction heating; and a support configured to rotatably support the rotation axis of said roller, wherein said support and said positioner have respective outer circumferential surfaces, and the respective outer circumferential surfaces of said support and said positioner are configured to retain said vibration absorber therebetween to define a circumferential cross-sectional shape of said vibration absorber.

7. An image heating device comprising:

a heat generator that extends between a plurality of rollers, each roller having a rotation axis, said heat generator having an outer surface and generating heat by induction heating;

a heater positioned close to the outer surface of said heat generator, said heater being configured to heat said heat generator by induction heating;

a positioner located close to an end of said heater, said positioner being configured to position said heater with respect to said heat generator;

a vibration absorber attached to said positioner and that is configured to absorb vibration of said heater produced when said heater heats said heat generator by induction heating, and a support configured to rotatably support the rotation axis of a roller, of the plurality of rollers, that is positioned adjacent said heater, wherein:

said support and said positioner have respective outer circumferential surfaces, the respective outer circumferential surfaces of said support and said positioner are configured to retain said vibration absorber therebetween to define a circumferential cross-sectional shape of said vibration absorber.

8. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator;

a vibration absorber attached to said positioner and that is configured to absorb vibration of said heater produced when said heater heats said heat generator by induction heating; and a current supply that supplies an exciting current having a predetermined frequency to said heater and causes said heater to perform induction heating, wherein:

said vibration absorber absorbs vibration caused by a vibration force having a frequency approximately double the frequency of said exciting current.

9. The image heating device according to claim 8, wherein said vibration absorber comprises a material with a vibration absorption performance that exceeds a predetermined level for frequencies not greater than approximately double the frequency of said exciting current.

10. The image heating device according to claim 8, wherein said vibration absorber comprises a material having a characteristic that the frequency corresponding to maximum vibration absorption performance is not greater than approximately twice the frequency of said exciting current.

11. The image heating device according to claim 9, wherein said vibration absorber comprises a material having a characteristic that a loss factor is approximately 0.01 or more for frequencies equal to or lower than approximately twice the frequency of said exciting current.

12. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator; and a vibration absorber attached to said positioner and that is configured to absorb vibration of said heater produced when said heater heats said heat generator by induction heating; and a current supply that supplies an exciting current modulated with a ripple component having a predetermined frequency to said heater and causes said heater to perform induction heating, wherein said vibration absorber absorbs vibration caused by a vibration force having substantially a same frequency as the frequency of said ripple component.

13. The image heating device according to claim 12, wherein said absorber comprises a material with a vibration absorption performance that exceeds a predetermined level for frequencies substantially equal to or lower than the frequency of said ripple component.

14. The image heating device according to claim 12, wherein said vibration absorber comprises a material having a characteristic that the frequency corresponding to maximum vibration absorption performance is substantially equal to or less than the frequency of said ripple component.

15. The image heating device according to claim 13, wherein said vibration absorber comprises a material having a characteristic that a loss factor is approximately 0.01 or more for frequencies substantially equal to or less than the frequency of said ripple component.

16. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator; and a vibration absorber attached to said positioner and that is configured to absorb vibration of said heater produced when said heater heats said heat generator by induction heating, wherein:

said vibration absorber comprises a material with a vibration absorption performance that exceeds a predetermined level at an arbitrary operating temperature, the material having a characteristic that a loss factor at an arbitrary operating temperature is approximately 0.01 or more.

17. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator;

a vibration absorber attached to said positioner and that is configured to absorb vibration of said heater produced when said heater heats said heat generator by induction heating, and a presser that presses said heater in a direction in which said heater approaches said heat generator.

18. An image heating device comprising:

a heat generator that has an outer surface and that generates heat by induction heating;

a heater positioned close to the outer surface of said heat generator, said heater being configured to heat said heat generator by induction heating;

a positioner located close to an end of said heater, said positioner being configured to position said heater with respect to said heat generator;

a vibration absorber attached to said positioner and that is configured to absorb vibration of said heater produced when said heater heats said heat generator by induction heating, and a regulator that regulates said heater to move only in a direction in which said heater approaches said heat generator or in a direction in which said heater retracts from said heat generator.

* * * * *

UNITED STATES PATENT AND TRADEMARK OFFICE

CERTIFICATE OF CORRECTION

PATENT NO. : 7,079,800 B2
APPLICATION NO. : 10/779615
DATED : July 18, 2006
INVENTOR(S) : Kenji Asakura et al.

It is certified that error appears in the above-identified patent and that said Letters Patent is hereby corrected as shown below:

On the title page of the printed patent, at Item (57), Abstract, "An image heating device according to an embodiment of the present invention includes a heat generator that has an outer surface and that generates heat by induction heating and a heater positioned close to the outer surface of the heat generator, the heater being configured to heat the heat generator by induction heating. A positioner is located close to an end of the heater, the positioner being configured to position the heater with respect to the heat generator. A vibration absorber is attached to the positioner and is configured, in one embodiment, to viscoelasticly absorb vibration of the heater produced by a vibration caused by an electromagnetic repulsive force acting between the heat generator and the heater when the heater heats the heat generator by induction heating." should be as follows:

--An image heating device has a configuration capable of reliably positioning a member to be heated and an excitation coil and of reliably preventing vibration transmission from the exciting coil to the member to be heated. The image heating device provides an exciting unit outside a heat generator provided with a heat generating belt which is a heating object, provides a positioner at an end of the exciting unit and provides a shock absorber between the positioner and a bearing so that the distance between the exciting unit and the heat generator is maintained at a predetermined distance.--

At column 12, line 39 (claim 2, line 6) of the printed patent, after "heater" insert -- , --.

Signed and Sealed this

Twenty-sixth Day of December, 2006

JON W. DUDAS
*Director of the United States Patent and Trademark Office*